US007677147B2

(12) United States Patent
Gambini

(10) Patent No.: US 7,677,147 B2
(45) Date of Patent: Mar. 16, 2010

(54) DEVICE AND METHOD FOR SEPARATING THE PAPER FROM THE CORES OF TRIMMINGS OF ROLLS OR LOGS OF RIBBON-LIKE MATERIAL, OF DEFECTIVE ROLLS OR LOGS AND/OR OF ANOTHER SIMILAR PRODUCT

(75) Inventor: Giovanni Gambini, Pisa (IT)

(73) Assignee: Gambini International S.A., RCS Luxembourg (LU)

( * ) Notice: Subject to any disclaimer, the term of this patent is extended or adjusted under 35 U.S.C. 154(b) by 591 days.

(21) Appl. No.: 11/412,489

(22) Filed: Apr. 27, 2006

(65) Prior Publication Data

US 2006/0260450 A1 Nov. 23, 2006

(30) Foreign Application Priority Data

May 19, 2005 (IT) ..... MI2005A0920

(51) Int. Cl.
*B26D 7/06* (2006.01)

(52) U.S. Cl. ..... 83/102; 83/102.1; 83/924

(58) Field of Classification Search ..... 83/13, 83/102, 154, 167, 924, 267, 89, 368, 435.2, 83/446, 508.2, 862; 242/521, 56.2
See application file for complete search history.

(56) References Cited

U.S. PATENT DOCUMENTS 1,838,011 A * 12/1931 St Peter ..... 83/862
3,204,501 A * 9/1965 Lane ..... 83/882
3,327,373 A * 6/1967 Somerville ..... 29/605
3,577,889 A * 5/1971 Eriksen ..... 83/863
3,762,249 A * 10/1973 Wheeler et al. ..... 83/864
3,818,587 A * 6/1974 Williams ..... 29/606
4,864,906 A * 9/1989 Hall ..... 83/886
5,367,930 A * 11/1994 Lemley ..... 83/368
5,453,070 A * 9/1995 Moody ..... 493/288
6,761,098 B1 * 7/2004 Esping et al. ..... 83/102

FOREIGN PATENT DOCUMENTS

CH 687 822 A5 2/1997
EP 1 231 320 A 8/2002

OTHER PUBLICATIONS

European Search Report, Oct. 4, 2006.

* cited by examiner

*Primary Examiner*—Ghassem Alie
(74) *Attorney, Agent, or Firm*—Hedman & Costigan, P.C.; James V. Costigan

(57) ABSTRACT

A device, for separating the paper from the cores of rolls or logs of paper or similar products, which is based on a combination of a mandrel that receives trimmings from a roll or log where the mandrel has an outer diameter that is less than the inner diameter of a core of at least one log. The mandrel is provided with at least one axial recess that is directed along several contiguous generatrices of the mandrel. Above the axial recess is arranged a circular rotating blade which cuts both said trimmings the core.

10 Claims, 3 Drawing Sheets

DEVICE AND METHOD FOR SEPARATING THE PAPER FROM THE CORES OF TRIMMINGS OF ROLLS OR LOGS OF RIBBON-LIKE MATERIAL, OF DEFECTIVE ROLLS OR LOGS AND/OR OF ANOTHER SIMILAR PRODUCT

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISK

Not Applicable

REFERENCE TO A MICROFICHE APPENDIX

Not Applicable

BACKGROUND OF THE INVENTION

1. Field of the Invention

The present invention refers to a device and a method for separating the paper from the cores of trimmings of rolls or logs of ribbon-like material, of defective rolls or logs and/or of another similar product.

2. Description of Related Art

Presently, in the production of rolls or the like of paper towels and/or toilet paper for private and/or industrial use, discards are produced during production of various types.

Firstly, during the formation of the paper rolls wrapped on cores or staffs of a pre-selected diameter and a certain height, due to gluing problems of the beginning of the roll, change of reel etc., some rolls are produced which do not respond to that requested.

Secondly, once correctly constituted rolls or logs are realised, one must proceed to the precise cutting of single final rolls ready for distribution and for the final use by the consumer. During this operation of predetermined precise cutting of these final rolls, by means of appropriate croppers, there is the formation of a plurality of fragments (trimmings) of size not corresponding to that requested. In addition, there may also be rolls of discard size for various reasons.

This discard type presents problems of disposal with recovery of the constituent material, since the inner core is realised with wrapped and glued cardboard, while the paper wrapped on the core would be recoverable as cellulose, therefore also of a certain value.

Presently, due to the bond between the two component parts which is difficult to dissolve except at high cost, it is preferred to destroy such discards, sending them to the macerator with losses of a certain weight.

It is therefore one object of the present invention to realise and set a device and/or method for separating the paper from the cores of trimmings of rolls or logs of ribbon-like material, of defective logs and/or of another similar product, resolving the above indicated general problem.

A further object of the invention is to realise a device of the above mentioned type which permits a quick and continuous separation from the paper cores, independent from their shape and size.

Another object is to realise a device for separate the paper from the cores which is extremely simple to build and easy to use.

Still another object is to realise a device for separating the paper from the cores which may follow the elevated work rates of the production machine, even with a simple structure.

Still another object is that of realising a method for separating the paper from the cores which may be easily used, without complicated and specific devices of operative elements.

BRIEF SUMMARY OF THE INVENTION

These objects according to the present invention are achieved by realising a device and a method for separating the paper from the cores of trimmings of rolls or logs of ribbon-like material, of defective logs and/or of another similar product as set forth in claim 1.

Further characteristics of the invention are outlined by the subsequent claims.

The characteristics and advantages of a device and a method for separating the paper from the cores of trimmings of rolls or logs of ribbon-like material, of defective logs and/or of another similar product according to the present invention shall be clearer from the following exemplifying and not limiting description.

With reference to the figures, a device is shown in general for separating the paper from the cores of rolls or logs of ribbon-like material, of defective rolls or logs and/or another similar product according to the present invention.

DETAILED DESCRIPTION OF THE INVENTION

Figure 1:
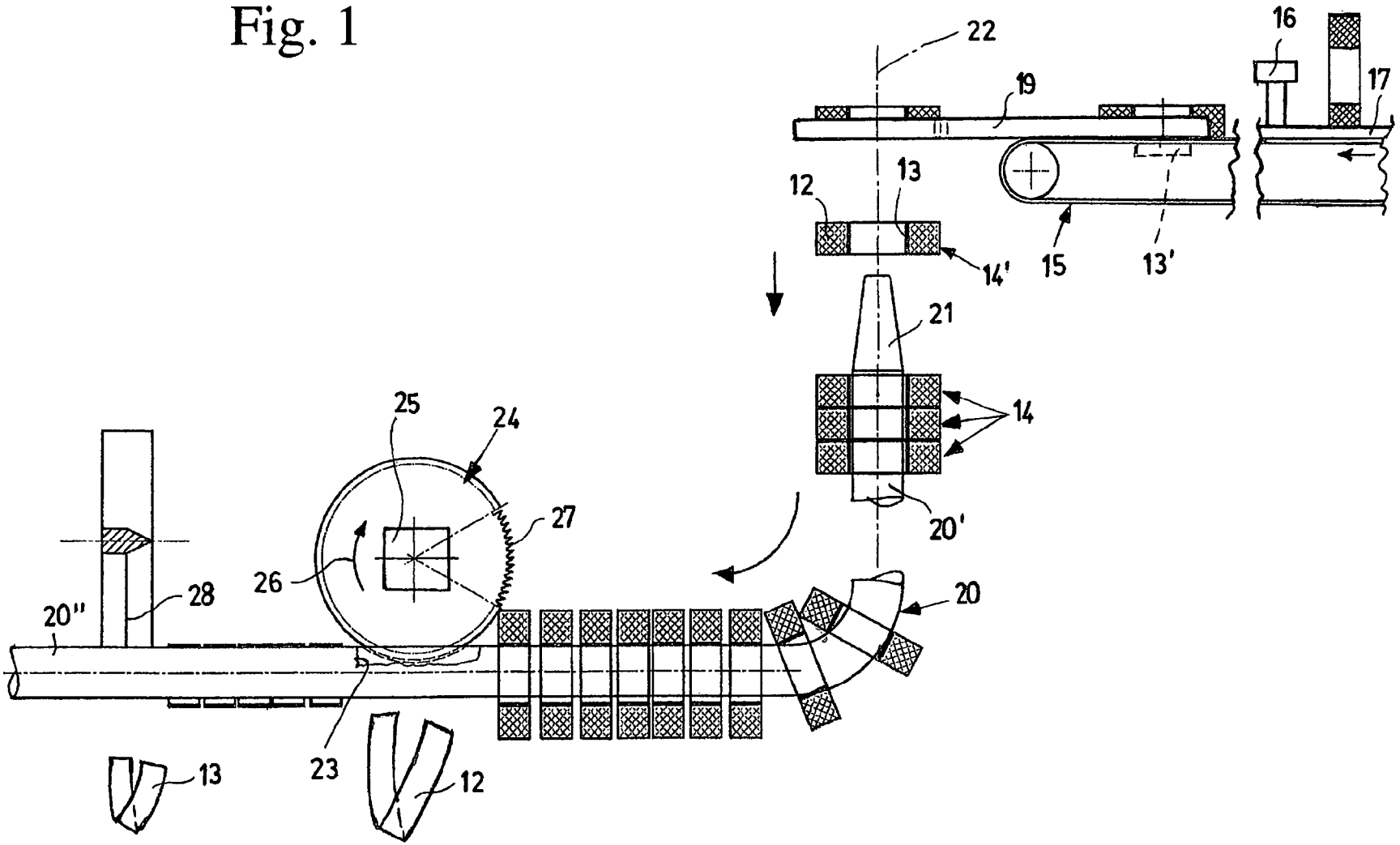
FIG. 1 is an elevation schematic view of a device for separating the paper from the cores of rolls of lateral ribbon-like material, realised according to the present invention.

FIG. 1 shows a device of the above said type utilised for separating a certain quantity of paper 12 on a core 13 making up part for example of a series of trimmings 14 of cylindrical form of rolls or logs of ribbon-like form (not shown), previously separated from these last. In this first embodiment, the device and the method use several preliminary steps, which are optional and possibly may be realised in other ways. Indeed, after the trimmings 14 of the logs were separated from the logs or in any case from the rolls of correct size (neither shown), such trimmings are arranged in bulk on or within generic collection elements (not shown), such as containers or the like. Moreover, in the shown example, it is foreseen that such trimmings 14 are arranged on a transport element, such a conveyor belt 15, which generally brings them towards a press (not shown). According to the device and the method of the invention, however, this conveyor belt 15 receives the trimmings 14 and advances them toward a further station, which they must reach in "lying down" position, i.e. with one of the two transverse surfaces lying on the surface of the conveyor 15, and aligned one after the other.

To such end it may be foreseen that the conveyor belt 15 has at least one vibrating portion, such to force the trimmings 14 to assume the aforementioned "lying down" position, or there may be present a bridge engagement element, schematised in 16, which causes and forces the trimmings 14, which knock against it, to fall into such position. It must be considered that in an alternative solution, not shown, the transport element 15 may be realised by two belts 15' and 15", spaced from each other and flanked to contain a possible projecting part 13' of core 13 (indicated with a dashed line in FIG. 1), turned downward between the belts, thus permitting an easy and ordered transportation.

The ordered arrangement, one after the other, of the trimmings 14 is realised through directing means, such as walls or channels 17 converging in the advancing direction, which force flanked trimmings 14 to arrange themselves in any case one after the other and to align themselves along a single longitudinal axis 18.

Figure 2:
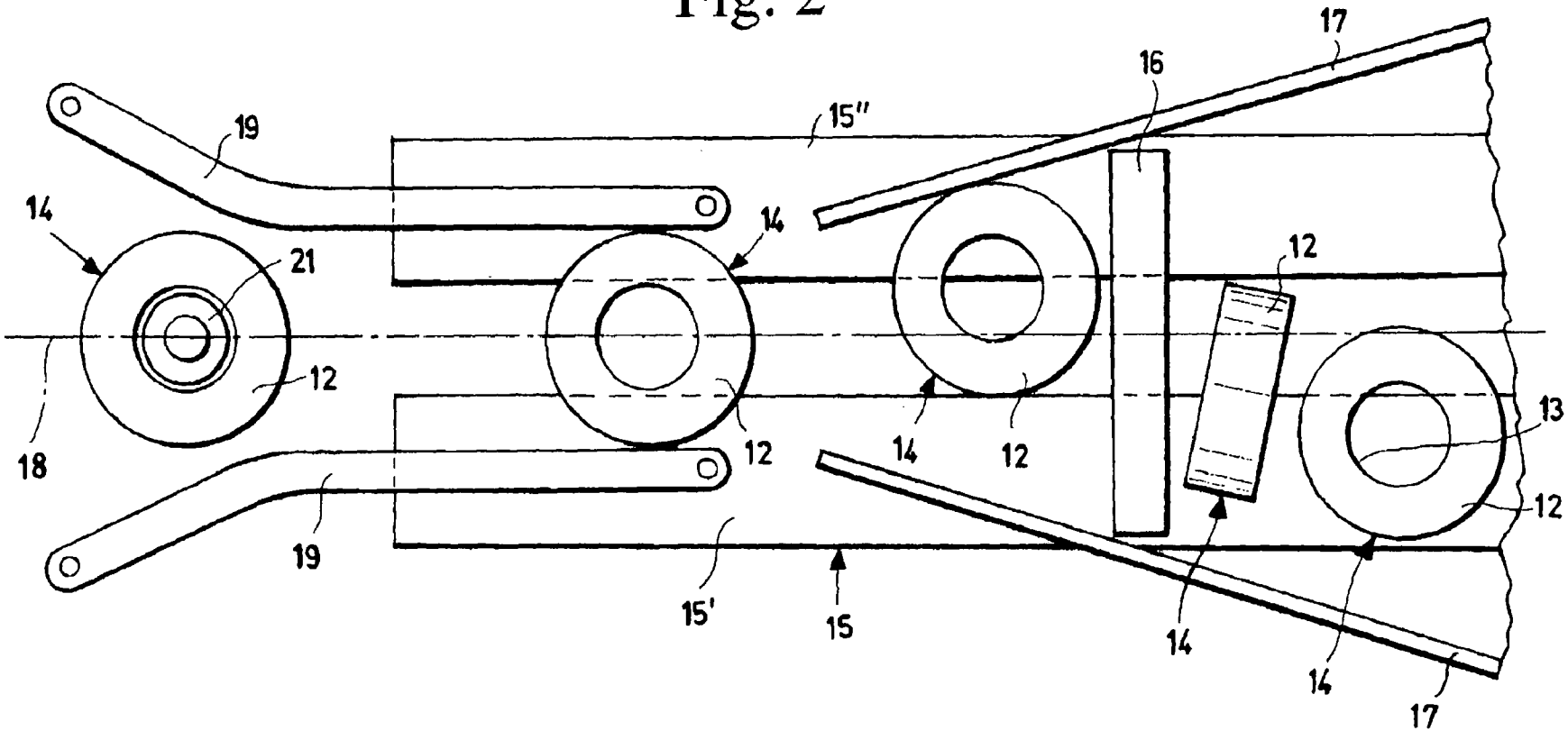
FIG. 2 is an enlarged schematic top plan view of part of that shown in FIG. 1 in the initial part of the device.

In the final part, moreover, it is foreseen that there are means of removal and release, constituted by a couple of side belts 19 (FIG. 2), with vertical surface, which draw the single trimming 14, pinching it on its side, from the conveyor belts 15' and 15" and release it along a predefined vertical direction, as shown for the trimming 14' in FIG. 1.

Below such side belts 19, a mandrel 20 is indeed foreseen presenting an initial frustoconical pointed zone 21 aligned along a vertical axis 22 which identifies the vertical release direction. In any case, the mandrel 20 must have an outer diameter less than the maximum inner diameter of the core 13 of the trimming 14.

The single trimmings 14, 14', one after the other reaching from the conveyor belts 15' and 15" and released along the direction of the vertical axis 22 on the initial pointed zone 21 of the mandrel 20, are arranged on the same, inserted one after the other.

The mandrel 20 is realised, for example, by a smooth continuous rod which has a first vertical portion 20' and a second horizontal portion 20" in which the separation between core 13 and paper 12 is realised of the single trimming 14.

In this second horizontal portion 20", the arrangement is foreseen of an axial recessing 23, directed along several contiguous generatrices of the mandrel 20 and, in the example, has a length at least equal to the thickness of the single trimming 14, but may be of any size.

Aligned above the axial recessing 23, a cutter is foreseen with circular blade 24, actuated to rotated by a respective motor 25. In a preferred embodiment, such circular blade 24 rotates in a clockwise direction according to the arrow 26, as represented in FIG. 1, i.e. in the advancing direction of the trimmings 14, pushed by their weight from the first vertical portion 20' to the second horizontal portion 20". Furthermore, in the circular blade 24 teeth 27 are foreseen arranged in opposite direction to that of the blade 24 rotation. In such a manner, the blade cuts both the paper 12 and the core 13 of the trimming 14.

Such cut causes an immediate separation of the paper 12, which as being soft is released and falls toward the bottom within a container or above a belt (neither shown), which immediately recover the paper as raw material.

The core 13, being rigid, continues moving above the horizontal portion 20" of the mandrel 20 until it meets a retractor element 28, either welded to the mandrel or arranged astride the mandrel 20, which forces the cut core 13 to open up and fall downward by gravity within a possible recovery container (not shown). Naturally, both the recessing 23 and the blade 24 may also be of a number greater than one around the mandrel 20.

Figure 3:
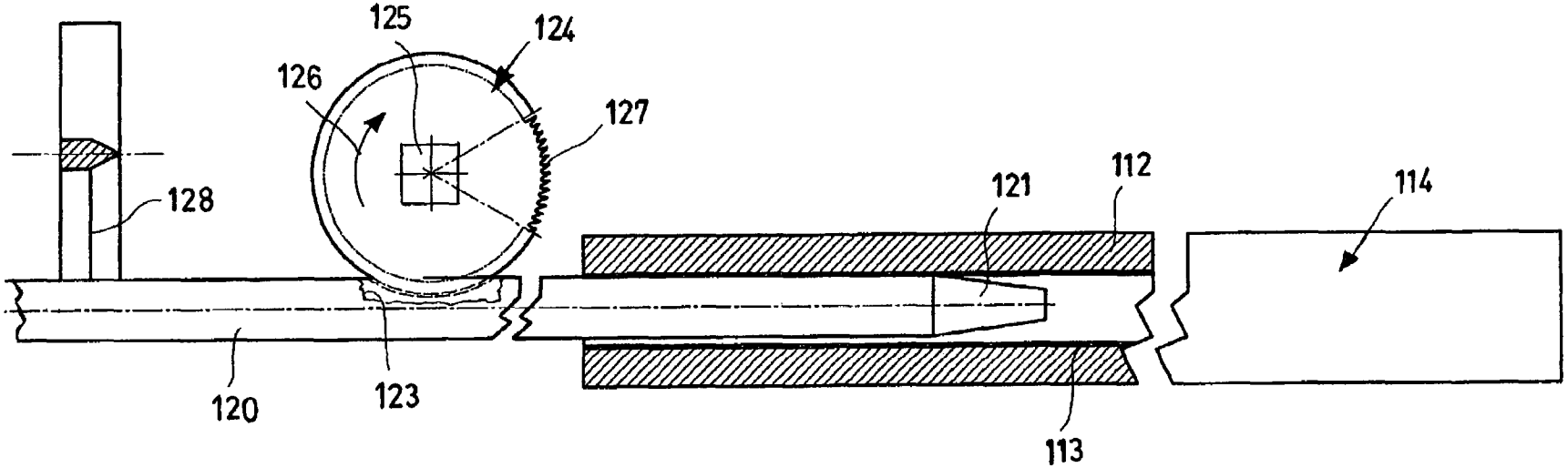
FIG. 3 is an elevation schematic view, partially in section, of a device for separating the paper from the cores of discard logs of lateral ribbon-like material, realised according to the present invention.

FIG. 3 is an elevation schematic view, partially in section, of a device for separating the paper from the cores of logs or pieces of discard logs of lateral ribbon-like material. In this embodiment, the same reference numbers are used for similar parts.

In the figure, it is noted how a single log or piece of discard log of lateral ribbon-like material 114 is inserted by hand or automatically on a mandrel 120 equipped with a frustoconical pointed terminal zone 121. It is evident that the pointed terminal zone 121 must have an outer diameter less than the maximum inner diameter of the core 113 of the log or piece of log 114.

The mandrel 120 foresees the arrangement of an axial recessing 123, directed along several contiguous generatrices of the mandrel 120. Aligned above the axial recessing 123, a cutter is foreseen with circular blade 124, actuated to rotate by a respective motor 125. As said for the previous example, the circular blade 124 rotates in clockwise direction according to the arrow 126, as represented in FIG. 3, i.e. in the advancing direction of the appropriately pushed logs 114. Furthermore, in the circular blade 124, teeth 127 are foreseen arranged in the opposite direction to that of the blade 124 rotation.

In this manner, the blade 124 cuts both the paper 112 and the core 113 of the log or log fragment 114.

Such cut causes an immediate separation of the paper 112, which as being soft is released and falls downward within a container or above a belt (neither shown) which immediately recover the paper as raw material.

The core 113, being rigid, continues moving on top of the mandrel 120 until it meets a retractor element 128, for example welded on the mandrel, which forces the cut core 113 to open itself and fall downward by gravity within a possible recovery container (not shown).

Thus it has been seen that a device and a method, as described in the various steps, realises the separation of the paper from the cores of trimmings of rolls or logs of ribbon-like material, of defective logs and/or of another similar product, and according to the present invention realises the previously outlined objects.

The device and the method of the present invention as conceived are susceptible to numerous modifications and variations, all coming under the same inventive concept.

Furthermore, in practice the materials utilised, as well as their dimensions and components, may be of any type according to the technical needs.

The invention claimed is:

1. Device for separating paper trimmings from the cores of paper rolls or logs, having an inner core (13, 113) around which paper (12, 112) is wrapped, where said paper rolls or logs are fed one after the other, to said device which comprises a mandrel (20, 120), which receives at least one trimming (14) or at least one log (114), and said mandrel has an outer diameter that is less than the inner diameter of an inner of an inner core (13, 113) of said at least one trimming (14) or at least one log (114), said mandrel (20, 120) having at least one axial recess (23, 123), directed along the mandrel (20, 120) above the at least one axial recess (23,123) there being positioned at least one rotating circular blade (24, 124) which is adapted to cut both said paper (12, 112) and said inner core (13, 113) wherein said mandrel (20) has a first vertical portion (20') and a second horizontal portion (20") in which the separation of the core (13) from the paper (12) of the at least one trimming (14) is accomplished, and wherein said mandrel comprises, positioned upstream from said second horizontal portion (20") of said mandrel (20), at least one transport element (15', 15") for said trimmings (14), directing means (17) to arrange said trimmings (14) one after the other along a single longitudinal axis (18) and means of removal and release (19) of a single trimming (14, 14") on said first vertical portion (20').

2. Device according to claim 1, wherein said rotating circular blade (24, 124) rotates in the advancing direction of said at least one trimming (14) or at least one log (114).

3. Device according to claim 1, wherein said rotating circular blade (24, 124) has teeth (27, 127) arranged in opposite direction to the direction in which the rotating blade (24, 124) rotates.

4. Device according to claim 1, wherein said mandrel (20, 120) has an initial frustoconical pointed zone (21, 121).

5. Device according to claim 1, wherein said at least one axial recess (23) and said at least one rotating circular blade (24) are arranged in said second horizontal portion (20").

6. Device according to claim 1, wherein said mandrel (20, 120) has a retractor element (28, 128) that is integral with said mandrel (20, 120) which is positioned downstream from said at least one axial recessing (23, 123) and said at least one rotating circular blade (24, 124).

7. Device according to claim 1, wherein said at least one transport element (15) for said trimmings (14) comprises two belts (15', 15"), spaced from each other and flanked to contain a projecting part (13') of said core (13) of said trimming (14).

8. Device according to claim 1, wherein said directing means comprise walls or channels (17) converging in the advancing direction of said trimmings (14).

9. Device according to claim 1, wherein said means of removal and release of a single trimming (14, 14') comprise a couple of lateral belts (19), with vertical surface, which draw the single trimming (14, 14') from said at least one transport element (15, 15', 15") and release said single trimming (14, 14') along a predefined vertical direction.

10. Device according to claim 1, wherein upstream from said horizontal portion (20"), on said at least one transport element (15, 15', 15") of said trimmings (14), an engagement element (16) is positioned to cause said trimmings (14) to assume a lying down position on said transport element (15, 15', 15").

* * * * *